US010347227B1

(12) United States Patent
Britt

(10) Patent No.: US 10,347,227 B1
(45) **Date of Patent: *Jul. 9, 2019**

(54) GUITAR PICK HOLDER

(71) Applicant: Kenneth R. Britt, Barhamsville, VA (US)

(72) Inventor: Kenneth R. Britt, Barhamsville, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/203,836

(22) Filed: Nov. 29, 2018

Related U.S. Application Data

(63) Continuation of application No. 16/101,829, filed on Aug. 13, 2018, now Pat. No. 10,210,849.

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS 9,734,806 B1 * 8/2017 Storck ..... G10D 3/163

* cited by examiner

*Primary Examiner* — Kimberly R Lockett
(74) *Attorney, Agent, or Firm* — Peter J. Van Bergen

(57) ABSTRACT

A guitar pick holder includes a receptacle having an open top and a closed bottom. A piston is provided within the receptacle and a retainer is fitted over the receptacle wherein the piston is disposed between the closed bottom of the receptacle and the retainer. The retainer has a partially open top at a side thereof. A spring is disposed between the closed bottom of the receptacle and the piston such that the piston is biased into contact with the retainer.

17 Claims, 5 Drawing Sheets

GUITAR PICK HOLDER

This is a continuation application of co-pending application Ser. No. 16/101,829, "GUITAR PICK HOLDER", filed on Aug. 13, 2018.

FIELD OF THE INVENTION

The invention relates generally to holders or receptacles, and more particularly to a holder for guitar picks.

BACKGROUND OF THE INVENTION

During rehearsals and performances, guitar players can break, drop, or lose multiple guitar picks. Each time this happens, the guitar player has to get a new pick from his/her pocket, from a supply kept nearby on a table, amp, etc., or from a bandmate. In each of these instances, the guitar player is challenged with quickly obtaining another pick.

SUMMARY OF THE INVENTION

Accordingly, it is an object of the present invention to provide a guitar pick holder that is readily accessible by a guitar player while they are playing guitar.

Another object of the present invention is to provide a guitar pick holder that securely retains a number of guitar picks while also providing a reliable dispensing operation.

Still another object of the present invention is to provide a guitar pick holder that can be optimally and securely positioned by a guitar player for their style of play.

Other objects and advantages of the present invention will become more obvious hereinafter in the specification and drawings.

In accordance with the present invention, a guitar pick holder includes a receptacle having an open top and a closed bottom. A piston is provided within the receptacle for sliding engagement within the receptacle. A retainer is fitted over the receptacle wherein the piston is disposed between the closed bottom of the receptacle and the retainer. The retainer has a partially open top at a side thereof. A spring is disposed between the closed bottom of the receptacle and the piston such that the piston is biased into contact with the retainer.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
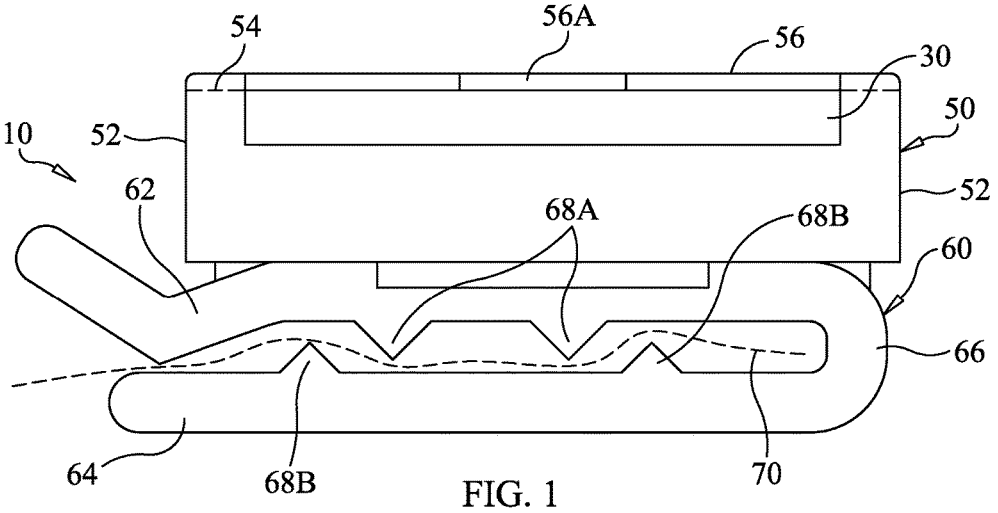
FIG. 1 is a side view of a guitar pick holder in accordance with an embodiment of the present invention.
Figure 2:
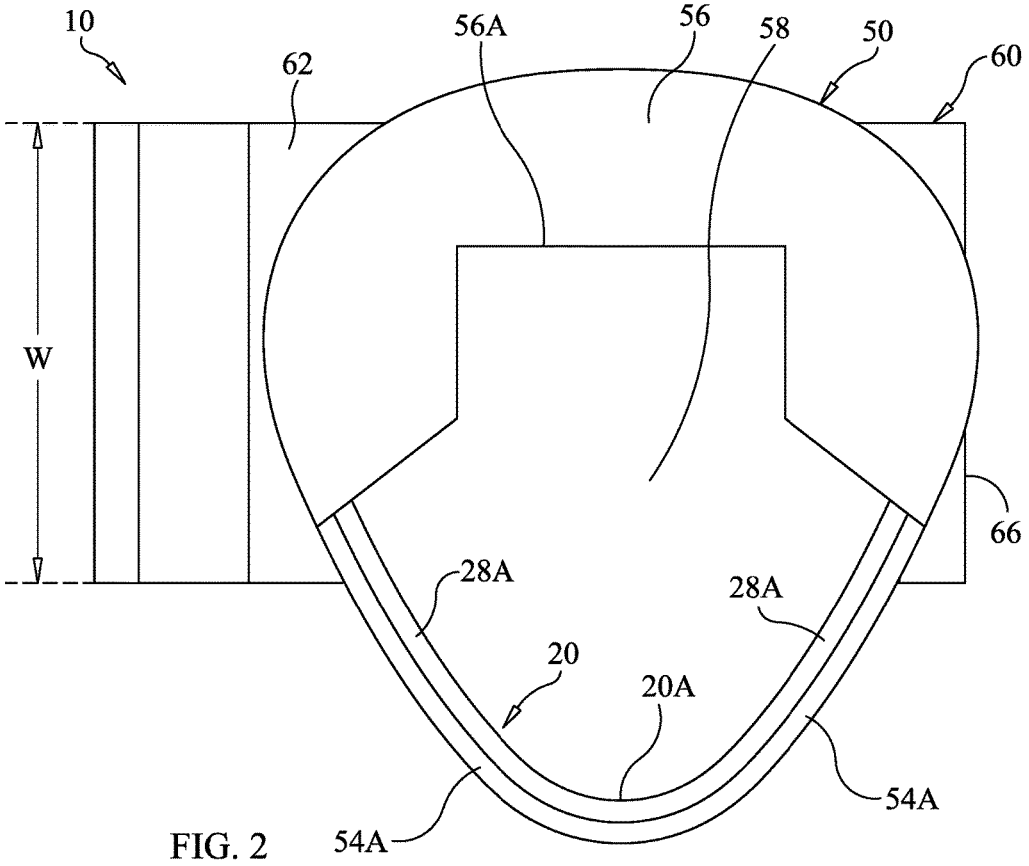
FIG. 2 is a top plan view of the guitar pick holder taken along line 2-2 in FIG. 1.
Figure 3:
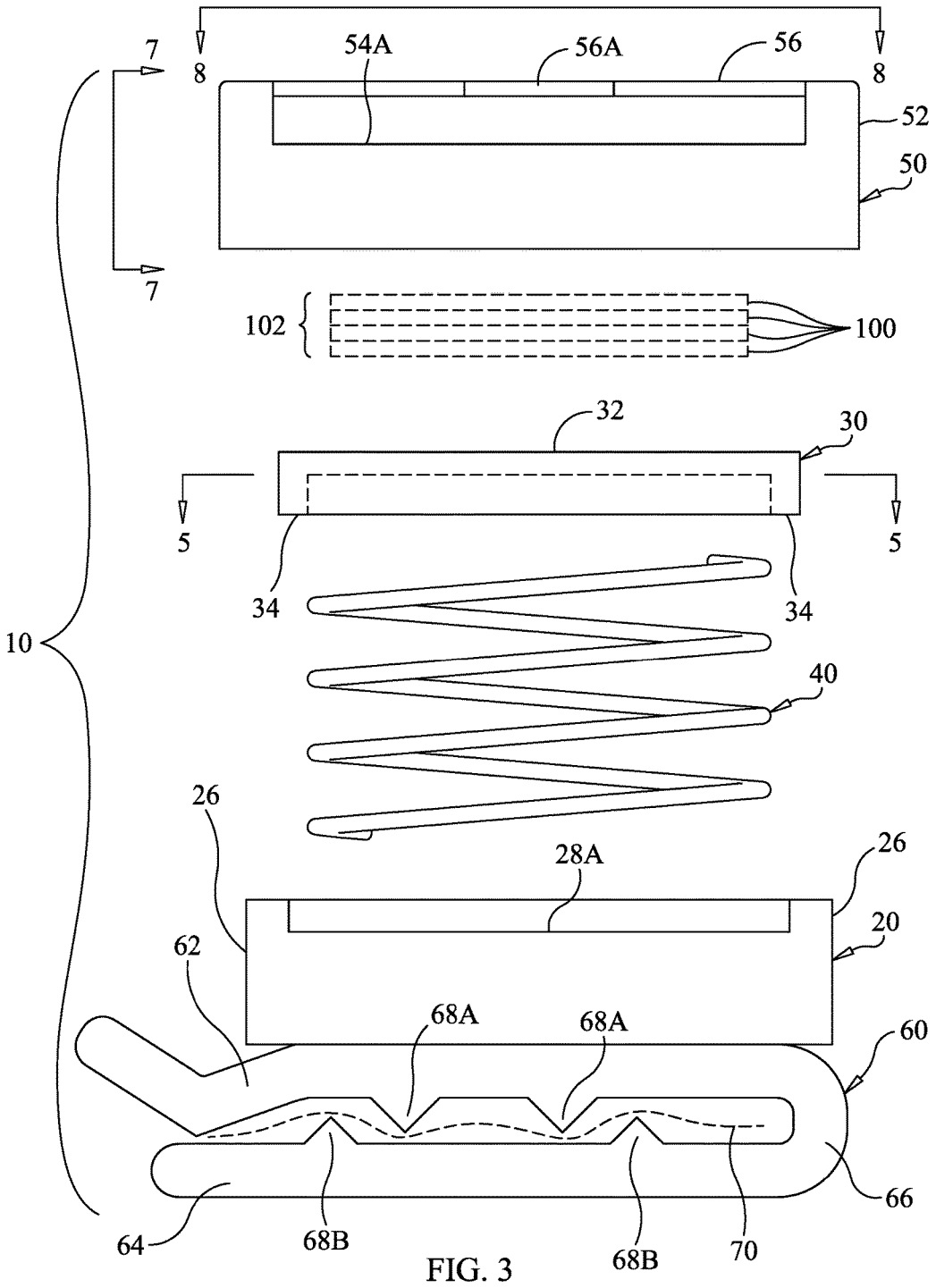
FIG. 3 is an exploded view of the guitar pick holder in accordance with an embodiment of the present invention.

Referring now to the drawings, FIGS. 1-8 will be referred to simultaneously in order to explain a guitar pick holder in accordance with an embodiment of the present invention. FIGS. 1-2 illustrate the guitar pick holder in its assembled condition where the guitar pick holder is referenced generally by numeral 10. FIG. 3 is an exploded view of guitar pick holder 10, and FIGS. 4-8 illustrate isolated views of various elements of guitar pick holder 10.

Guitar pick holder 10 includes a pick-holding receptacle 20, a piston 30 that fits and slides within receptacle 20, a spring 40 disposed in receptacle 20, a retainer 50 that fits over receptacle 20 to hold piston 30 and spring 40 therein, and a clip 60 coupled to receptacle 20. Receptacle 20, piston 30, retainer 50, and clip 60 are typically made from rigid materials such as plastics, composites and/or metals. Spring 40 will generally be made from a metal. Not all of the above elements are visible in every view. Further, spring 40 is only visible in the exploded view of (FIG. 3) of holder 10 and the isolated view of (FIG. 6) showing the relationship between spring 40 and piston 30 in an embodiment of the present invention.

Receptacle 20, piston 30, and retainer 50 are shaped and sized commensurate with a conventional guitar pick, i.e., an acute isosceles triangle whose corners are rounded. Accordingly, receptacle 20 has an apex corner 20A and two base corners 20B and 20C.

Receptacle 20 is shaped and sized such that its interior volume 22 (FIG. 4) can store a plurality of guitar picks 100 that are shown in phantom in FIG. 3 to indicate that picks 100 are not part of holder 10. More specifically, interior volume 22 is shaped and sized to maintain picks 100 in a stacked arrangement 102 thereof within receptacle 20. Receptacle 20 has a closed bottom 24, a side wall 26 extending from closed bottom 24 up to an open top 28 whose top edge is notched over a region thereof in the vicinity of apex corner 20A as indicated by reference numeral 28A. Side wall 26 is lower at notched region 28A to facilitate insertion/dispensing of guitar picks 100 as will be explained later below.

As mentioned above, piston 30 fits and slides within receptacle 20. Piston 30 serves as a base/floor on which the stack of guitar picks 100 rests when holder 10 is in use. Piston 30 also serves as a "pusher" as guitar picks 100 are pressed up against retainer 50 as will be explained further below. To assure reliable movement of piston 30 within receptacle 20 as controlled by spring 40, the present invention can incorporate a unique piston-spring construction as will now be explained with reference to FIGS. 5-6. Piston 30 includes a base 32 and an annular flange 34 at the perimeter of base 32. By way of example, base 32 and flange 34 can be integrated with one another. Spring 40 is sized to rest on closed bottom 24 of receptacle 20 and bear against piston 30, while making tangential contact with annular flange 34 as indicated by reference numerals 40A, 40B and 40C. In this way, piston 30 and/or spring 40 are prevented from getting stuck in an angular relationship within receptacle 20 during use of holder 10.

Retainer 50 is fitted over receptacle 20 once spring 40 and piston 30 are placed in receptacle 20. Retainer 50 keeps piston 30 and spring 40 in receptacle 20, while also facilitating the insertion and removal of guitar picks 100 into and from, respectively, holder 10. Retainer 50 can be configured for permanent attachment to receptacle 20 or be removably attached to receptacle 20 without departing from the scope of the present invention. Retainer 50 includes a side wall 52 having a top edge 54, and a top 56 coupled to a portion of top edge 54 such that an opening 58 is defined between side wall 52 and top 56 and such that an exposed top-edge portion 54A is defined. Side wall 52 and top 56 can be fabricated as an integrated unit or can be assembled as a unit without departing from the scope of the present invention. In general, retainer 50 is configured such that opening 58 permits the passage of a guitar pick there through to thereby facilitate the insertion/removal of a guitar pick from holder 10. For example, in the illustrated embodiment, top 56 is notched at 56A such that a user's fingertip can pass through notch 56. Notch 56A provides more surface area access to the top face of a guitar pick at the top of a stack in holder 10. As best illustrated in FIG. 2, the exposed top-edge portion 54A of top edge 54 aligns with the above-described notched region 28A of receptacle 20 so that a guitar pick can be slide into from holder 10.

Figure 4:
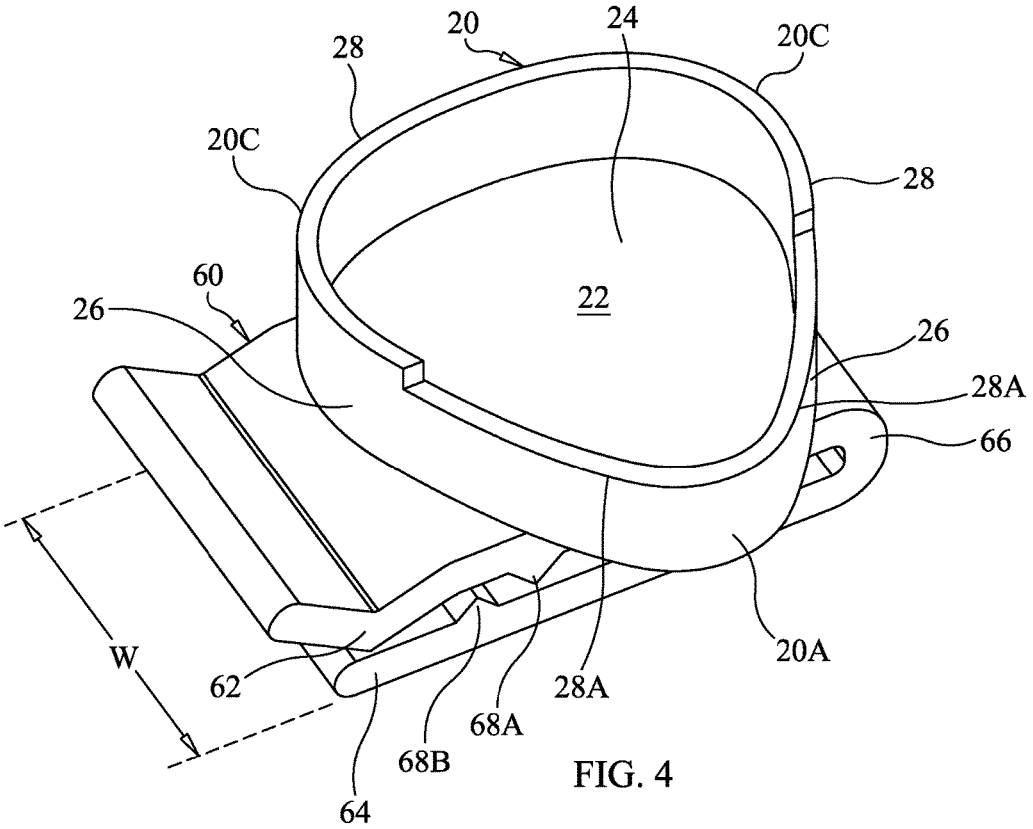
FIG. 4 is an isolated perspective view of the guitar pick holder's integrated clip and receptacle.
Figure 5:
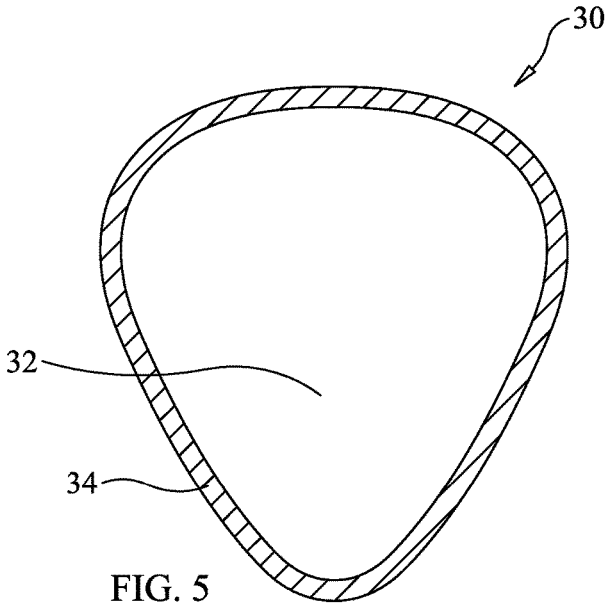
FIG. 5 is a cross-sectional view of the guitar pick holder's piston taken along line 5-5 in FIG. 3.
Figure 6:
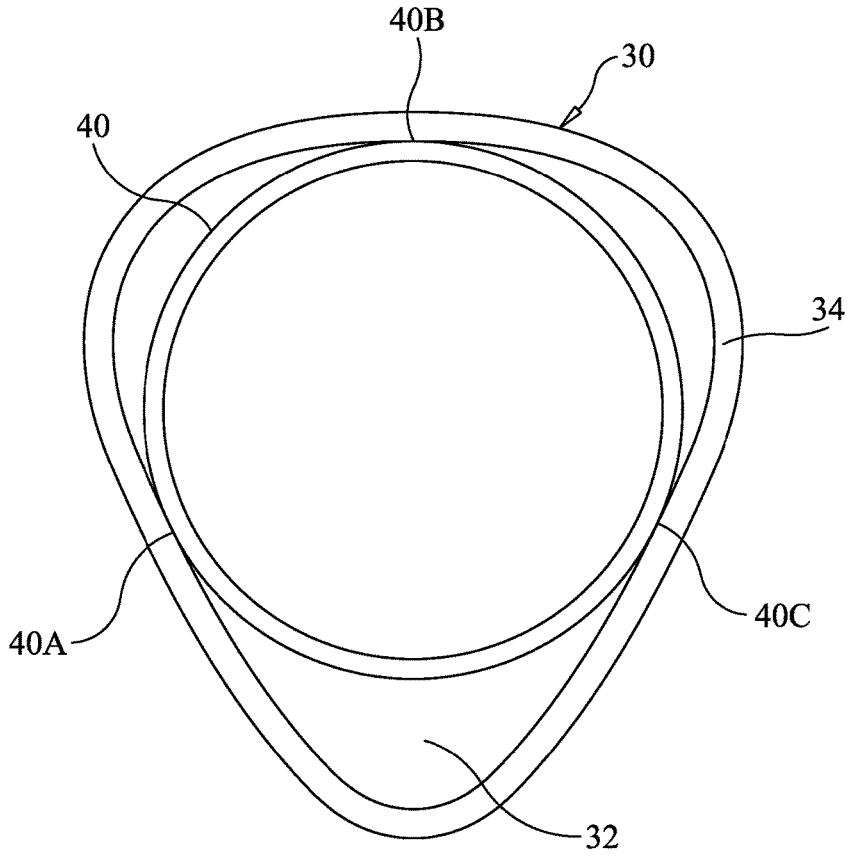
FIG. 6 is an isolated plan view of the underside of the guitar pick holder's piston and spring in accordance with an embodiment of the present invention.
Figure 7:
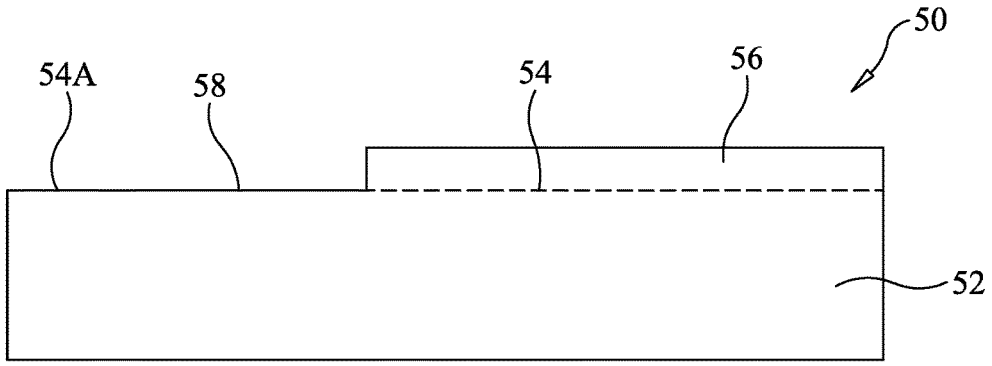
FIG. 7 is an isolated side view of the guitar pick holder's retainer taken along line 7-7 in FIG. 3.
Figure 8:
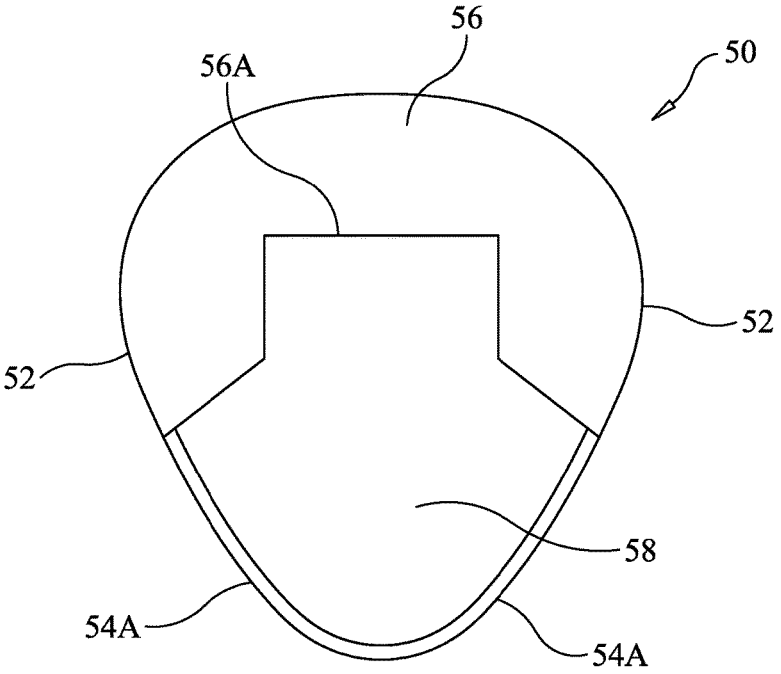
FIG. 8 is an isolated top plan view of the guitar pick holder's retainer taken along line 8-8 in FIG. 3.

As mentioned previously, clip 60 is coupled to receptacle 20 at an outside surface of the receptacle's closed bottom 24. Referring simultaneously to FIGS. 1, 3 and 4, clip 60 and receptacle 20 can be fabricated as an integrated unit or assembled from separate parts without departing from the scope of the present invention. In the illustrated embodiment, clip 60 is U-shaped with legs 62 and 64 opposing one another in a spaced-apart fashion and coupled together at a joint 66 such that legs 62 and 64 can be moved slightly away from one another but elastically return to their illustrated orientation. Each of legs 62 and 64 includes multiple triangular ridges spanning the width "W" (FIG. 4) of clip 60. More specifically, triangular ridges 68A are integrally included on leg 62 such that they face or point to leg 64. Triangular ridges 68B are integrally included on leg 64 such that they face or point to leg 62. In the illustrated embodiment, ridges 68A and 68B are parallel to one another with ridges 68A positioned between ridges 68B.

The apex of each of ridges 68A and 68B is spaced apart from the opposing leg 64 and 62, respectively, such that an open undulating channel is defined between legs 62 and 64 as indicated by dashed line 70 (FIG. 1). Channel 70 facilitates the placement of clip onto a guitar strap, open edge of a clothing pocket, top of pants, etc. Triangular ridges 68A and 68B combined with the undulating nature of channel 70 securely hold clip 60 in place once a strap or clothing fabric is positioned in channel 70.

The advantages of the present invention are numerous. The unique guitar pick holder can securely store a stack of guitar picks and be readily and removably attached to a guitar player's strap, clothing, etc. The pick holder can be placed at a preferred location without damaging the point of attachment. The holder's unique piston-spring construction assures a reliable pick dispensing device.

Figure 9:
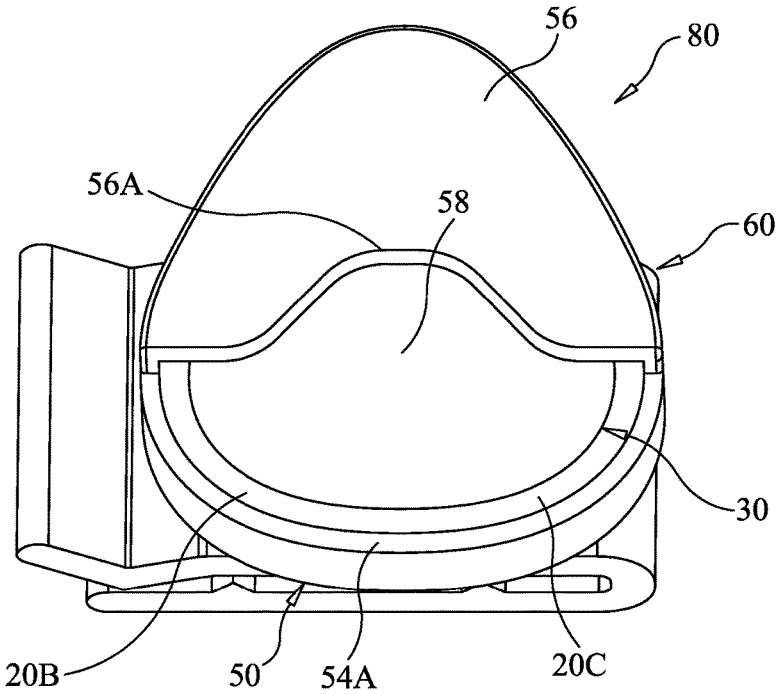
FIG. 9 is a top perspective view of a guitar pick holder in accordance with another embodiment of the present invention.

Although the invention has been described relative to a specific embodiment thereof, there are numerous variations and modifications that will be readily apparent to those skilled in the art in light of the above teachings. For example, FIG. 9 illustrates another guitar pick holder 80 that is identical in construction to the above-described guitar pick holder 10 except that top 56 of retainer 50 is configured such that opening 58 defines an exposed top-edge portion 54A that is in alignment with base corners 20B and 20C of receptacle 20. In this embodiment, a guitar's pick's pointed end tip (not shown) is the portion of the guitar pick that is pushed into guitar pick holder 80. It is therefore to be understood that, within the scope of the appended claims, the invention may be practiced other than as specifically described.

What is claimed as new and desired to be secured by Letters Patent of the United States is:

1. A guitar pick holder, comprising:

a receptacle having an open top and a closed bottom;

a piston for sliding engagement within said receptacle;

a retainer fitted over said receptacle wherein said piston is disposed between said closed bottom of said receptacle and said retainer, said retainer having a partially open top at a side thereof; and a spring disposed between said closed bottom of said receptacle and said piston, wherein said piston is biased into contact with said retainer.

2. A guitar pick holder as in claim 1, wherein said receptacle is adapted to store a plurality of guitar picks therein between said piston and said retainer.

3. A guitar pick holder as in claim 1, wherein said open top is adapted to permit passage of a guitar pick there through.

4. A guitar pick holder as in claim 1, wherein said piston includes an annular flange, and wherein said spring is in tangential contact with said annular flange.

5. A guitar pick holder as in claim 1, further comprising a clip coupled to an outside surface of said closed bottom of said receptacle.

6. A guitar pick holder as in claim 5, wherein said clip comprises a U-shaped clip having a first leg coupled to said closed bottom of said receptacle and having a second leg coupled to and opposing said first leg, said first leg including first triangular ridges facing said second leg, said second leg including second triangular ridges facing said first leg, wherein an undulating open channel is defined between said first leg and said second leg.

7. A guitar pick holder, comprising:

a receptacle having an open top and a closed bottom;

a piston for sliding engagement within said receptacle;

a retainer fitted over said receptacle, said retainer having a side wall with a top edge, said retainer having a top coupled to a portion of said top edge of said side wall wherein said retainer is adapted to permit passage of a guitar pick between said top and said top edge of said sidewall, and wherein said piston is disposed between said closed bottom of said receptacle and said top of said retainer; and a spring disposed between said closed bottom of said receptacle and said piston, wherein said piston is biased into contact with said top of said retainer.

8. A guitar pick holder as in claim 7, wherein said receptacle is adapted to store a stack of guitar picks therein between said piston and said top of said retainer.

9. A guitar pick holder as in claim 7, wherein said piston includes an annular flange, and wherein said spring is in tangential contact with said annular flange.

10. A guitar pick holder as in claim 7, further comprising a clip coupled to an outside surface of said closed bottom of said receptacle.

11. A guitar pick holder as in claim 10, wherein said clip comprises a U-shaped clip having a first leg coupled to said closed bottom of said receptacle and having a second leg coupled to and opposing said first leg, said first leg including first triangular ridges facing said second leg, said second leg including second triangular ridges facing said first leg, wherein an undulating open channel is defined between said first leg and said second leg.

12. A guitar pick holder, comprising:

a receptacle having an open top and a closed bottom;

a piston for sliding engagement within said receptacle;

a retainer fitted over said receptacle, said retainer having a side wall with a top edge, said retainer having a notched top coupled to a portion of said top edge of said side wall wherein said retainer is adapted to permit passage of a guitar pick between said notched top and said top edge of said side wall, and wherein said piston is disposed between said closed bottom of said receptacle and said notched top; and a spring disposed between said closed bottom of said receptacle and said piston, wherein said piston is biased into contact with said notched top of said retainer.

13. A guitar pick holder as in claim 12, wherein said receptacle is adapted to store a stack of guitar picks therein between said piston and said notched top of said retainer.

14. A guitar pick holder as in claim 12, wherein said piston includes an annular flange, and wherein said spring is in tangential contact with said annular flange.

15. A guitar pick holder as in claim 12, further comprising a clip coupled to an outside surface of said closed bottom of said receptacle.

16. A guitar pick holder as in claim 15, wherein said clip comprises a U-shaped clip having a first leg coupled to said closed bottom of said receptacle and having a second leg coupled to and opposing said first leg, said first leg including first triangular ridges facing said second leg, said second leg including second triangular ridges facing said first leg, wherein an undulating open channel is defined between said first leg and said second leg.

17. A guitar pick holder as in claim 12, wherein said receptacle is notched at a region thereof adjacent said open top of said receptacle, wherein said top edge of said retainer has an exposed portion adjacent said notched top, and wherein said region of said receptacle aligns with said exposed portion of said top edge when said retainer is fitted over said receptacle.

* * * * *